US007346987B2

(12) United States Patent
Erbrick

(10) Patent No.: US 7,346,987 B2
(45) Date of Patent: Mar. 25, 2008

(54) CUTTING TOOL WITH WORK PIECE FEED MECHANISM

(75) Inventor: Robert S. Erbrick, Doylestown, PA (US)

(73) Assignee: Electroline Corporation, Pipersville, PA (US)

( * ) Notice: Subject to any disclaimer, the term of this patent is extended or adjusted under 35 U.S.C. 154(b) by 98 days.

(21) Appl. No.: 11/294,308

(22) Filed: Dec. 5, 2005

(65) Prior Publication Data

US 2006/0070245 A1 Apr. 6, 2006

Related U.S. Application Data

(63) Continuation-in-part of application No. 10/256,617, filed on Sep. 27, 2002, now Pat. No. 6,971,179.

(51) Int. Cl.
*B26B 13/22* (2006.01)

(52) U.S. Cl. ..... 30/134; 30/191; 30/193

(58) Field of Classification Search ..... 30/124, 30/131, 175, 186, 191, 178, 179.2, 92, 99, 30/134, 180, 192, 193
See application file for complete search history.

(56) References Cited

U.S. PATENT DOCUMENTS

| | | | | | |
|---|---|---|---|---|---|
| 102,006 | A | | 4/1870 | Howard | |
| 547,101 | A | | 10/1895 | Williams | |
| 1,626,274 | A | * | 4/1927 | Duffy | 30/90.2 |
| 1,735,317 | A | * | 11/1929 | Helwig et al. | 30/124 |
| 1,862,033 | A | * | 6/1932 | Porter | 30/131 |
| 1,901,739 | A | * | 3/1933 | Engel | 30/131 |
| 2,256,779 | A | | 9/1941 | McHenry | |
| 2,341,654 | A | | 2/1944 | Richter | |
| 3,025,599 | A | | 3/1962 | Sauers et al. | |
| 3,122,036 | A | * | 2/1964 | Flower et al. | 30/91.2 |
| 3,273,240 | A | * | 9/1966 | Florian | 30/251 |
| 3,358,541 | A | | 12/1967 | Frei | |
| 3,949,473 | A | * | 4/1976 | Blanc | 30/191 |
| 4,505,038 | A | | 3/1985 | Porter | |
| 4,599,795 | A | * | 7/1986 | Yokoyama | 30/188 |
| 4,747,212 | A | | 5/1988 | Cavdek | |
| 4,899,445 | A | | 2/1990 | Erbrick et al. | |
| 4,910,870 | A | | 3/1990 | Chang | |
| 4,998,351 | A | | 3/1991 | Hartmeister | |
| 5,187,869 | A | | 2/1993 | Heiss | |
| 5,195,353 | A | | 3/1993 | Erbrick et al. | |
| 5,218,768 | A | * | 6/1993 | Putsch et al. | 30/250 |
| 5,226,236 | A | * | 7/1993 | Harrington, III | 30/134 |

(Continued)

*Primary Examiner*—Maurina Rachuba
(74) *Attorney, Agent, or Firm*—Panitch Schwarze Belisario & Nadel LLP

(57) ABSTRACT

A cutting tool having a work piece feed mechanism includes a first jaw and a second jaw connected together for pivotal movement between a closed position and an open position. The work piece feed mechanism includes first and second ratchet members as well as a slide member adapted to engage a work piece and mounted for movement between a fully extended position and a fully retracted position. Movement of the first and second jaws from the closed position to the open position causes the first ratchet member to operably engage the slide member and incrementally advance the slide member toward the fully retracted position. Movement of the first and second jaws from the open position to the closed position causes the second ratchet member to operably engage the slide member to restrain the slide member from movement toward the fully extended position.

18 Claims, 6 Drawing Sheets

U.S. PATENT DOCUMENTS 5,272,811 A 12/1993 Armand
5,307,565 A * 5/1994 Erbrick et al. ..... 30/251
5,454,754 A 10/1995 Baertlein
5,590,470 A 1/1997 Erbrick et al.
5,755,293 A 5/1998 Bourke
6,178,643 B1 1/2001 Erbrick et al.
6,971,179 B2 * 12/2005 Erbrick ..... 30/191

* cited by examiner

CUTTING TOOL WITH WORK PIECE FEED MECHANISM

CROSS-REFERENCE TO RELATED APPLICATIONS

This application is a continuation-in-part of and claims benefit of U.S. patent application Ser. No. 10/256,617, "CUTTING TOOL", filed on Sep. 27, 2002, now U.S. Pat. No. 6,971,179, issued Dec. 6, 2005.

BACKGROUND OF THE INVENTION

The present invention relates generally to cutting tools, and more particularly to cutting tools having a work piece feed mechanism operative to incrementally feed a work piece into the cutting tool.

Hand tools for cutting material are well-known. Such tools may be manually actuated or powered by a motor, compressed air, or the like. Conventional cutting tools being referred to generally include a pair of opposing jaws with one or two sharpened edges which pivot such that the jaws can be separated and brought together, often using levers to actuate the jaws, forcing the sharpened edge(s) against the material to be cut. The cutting stroke generally begins with the jaws being separated as the levers are moved apart. The material to be cut is inserted between the opened jaws and the jaws are forced together as the levers are moved together, creating a force which exceeds the strength of the material within the jaws, thus cutting the material. Typically, the jaws come together in either a shear action (e.g. scissors), where the jaw edges overlap at the end of the cutting stroke, or in an abutting action (e.g. typical bolt cutters), where the jaw edges abut one another at the end of the cutting stroke. The force imposed on the material for a given lever force increases as either the length of the levers (as measured from the point of application of force to the levers to the lever pivot point) increases or the distance between the pivot point and the work piece decreases.

A deficiency of the prior art is that conventional shear type cutting tools are not suitable for cutting relatively thick materials. When cutting very thin materials, shear type tools work well because the work piece can be entered and advanced successively with limited opening of the blades. However, as the thickness of the work piece increases, the cutting action becomes less efficient. With shear type cutting tools, twisting forces are developed by the non-aligned cutting members. As the thickness of the work piece increases, the twisting forces tend also to increase. Twisting forces are undesirable in that they tend to cause the blades to misalign (in turn tending to further increase the twisting forces), decreasing the cutting force applied to the work piece and potentially damaging the cutting edges.

Typically, cutting tools with abutting jaws, such as cutting pliers or bolt cutters, are used to cut relatively thicker objects such as wire cable, bolts and rods. The abutting, in-line cutting action of these tools, where the cutting forces are in alignment, eliminates or minimizes the twisting forces characteristic of the shear type devices. However, conventional abutting jaw type devices also suffer from some deficiencies. The jaws must be moved from their abutting closed position to an open position such that the jaws are spread sufficiently to accommodate the full thickness of the work piece, which typically requires substantial movement of the actuating levers. However, to maintain mechanical advantage, the cutting edge(s) must be close to the pivot(s) and the length of the edge(s) must be limited. Also, the angular spread of the jaws must be limited to limit the component of the forces that the jaws apply to the object which tend to push the object from the jaws. The limited jaw length, angular spread, and mechanical advantage that can be generated limit the thickness of the objects that can be cut by conventional hand tools with abutting jaws. Furthermore, at some point, the thickness of the object becomes so great that it is not possible to generate sufficient mechanical advantage to sever the object.

A need exists, therefore, for a cutting tool with jaws adapted to cut relatively thick, high strength materials, such as metal cables.

BRIEF SUMMARY OF THE INVENTION

According to one aspect of the invention, a cutting tool with a work piece feed mechanism comprises a first jaw having first and second ends and an edge extending between the first and second ends. At least a portion of the first jaw edge proximal the first end is sharpened to form a cutting edge portion. A second jaw having first and second ends and an edge extending between the first and second ends is also provided, with at least a portion of the second jaw edge facing the cutting edge portion of the first jaw edge. The first and second jaws are connected together for pivotal movement between a closed position with the cutting edge portion and the facing edge portion in cutting opposition and an open position with the cutting edge portion and the facing edge portion spaced apart. A work piece feed mechanism is operably coupled with at least one of the first and second jaws and includes a slide member adapted to engage a work piece and slide with the work piece relative to the first and second jaws between a fully extended position most distal to the first and second jaws and a fully retracted position most proximal to the first and second jaws. With the slide member extended from the fully retracted position, movement of the first and second jaws from the closed position to the open position causes a remainder of the work piece feed mechanism to advance the slide member and any work piece supported by the slide member toward the fully retracted position. Movement of the first and second jaws from the open position to the closed position causes the remainder of the work piece feed mechanism to operably restrain the slide member from movement toward the fully extended position.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
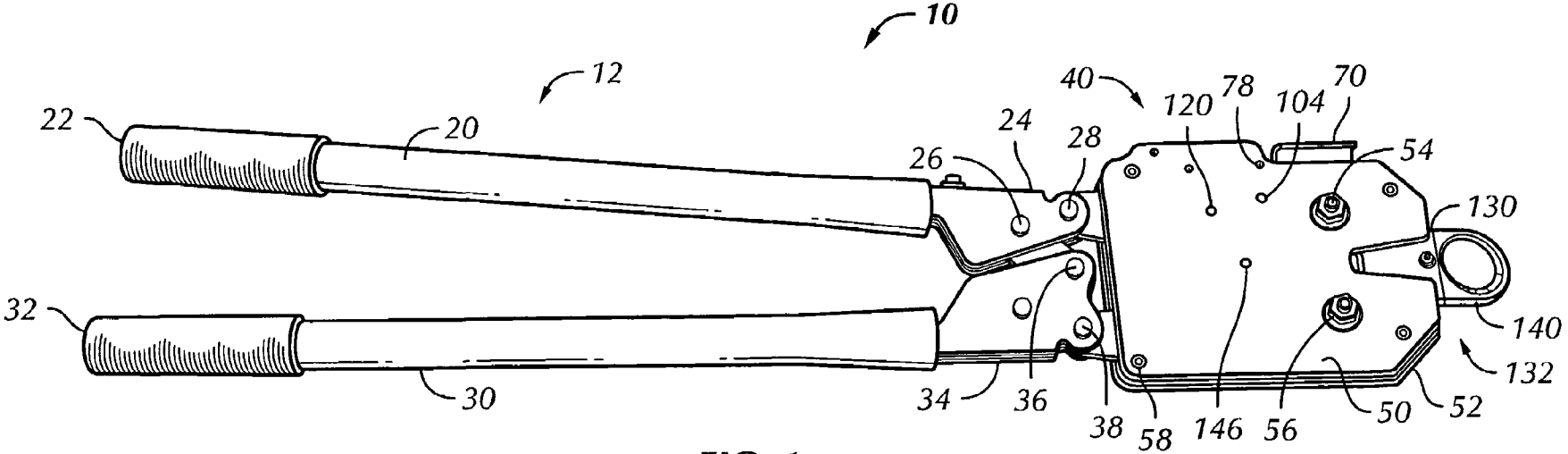
FIG. 1 is a perspective view of a presently preferred embodiment of a cutting tool having a work piece feed mechanism in accordance with the present invention, showing first and second handles in a closed position, and showing a slide member in a fully retracted position.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the cutting tool, and designated parts thereof. The terminology includes the words noted above, derivatives thereof and words of similar import. Additionally, the word "a", as used in the specification, means at least one.

Referring to the drawings in detail, where like numerals indicate like elements throughout, there is shown in FIGS. 1-6 a preferred embodiment of cutting tool having a work piece feed mechanism, generally designated 10, in accordance with the present invention. The cutting tool 10 comprises a cutting head assembly 40 having a first jaw 160, a second jaw 180, and a work piece feed mechanism 60. The work piece feed mechanism 60 includes a release lever 70, a first ratchet member 80, a second ratchet member 110, and a slide member 130. The cutting tool 10 comprises means for pivoting the first and second jaws 160, 180 between an open position 18 and a closed position 16. A preferred means for pivoting the first and second jaws 160, 180 are first and second handles 20, 30, respectively.

Figure 2:
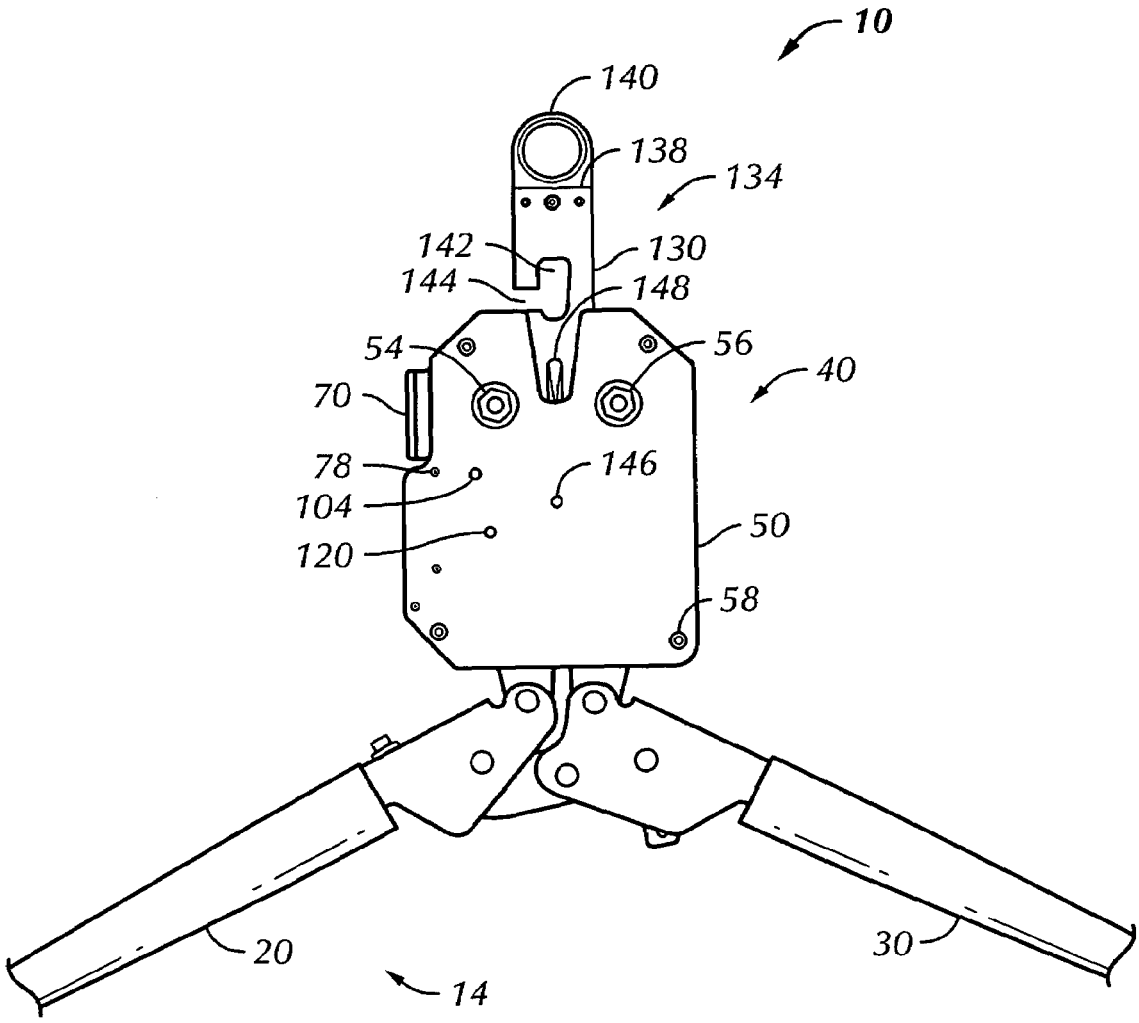
FIG. 2 is a front elevation view of a cutting head and portions of the handles of the cutting tool of FIG. 1, showing the handles in an open position, and showing the slide member in a fully extended position.

With particular reference to FIGS. 1 and 2, in the illustrated embodiment the cutting tool 10 is provided with first and second handles 20, 30 movable between a closed position 12 and an open position 14. The handles 20, 30 are conventional, each having a first end 22, 32, respectively and a second end 24, 34, respectively. The handles 20, 30 are connected to one another by a link pivotally coupled to the handles at first pivot connections 26, 36, respectively. The first handle 20 is pivotally connected to first jaw 160 at a first handle second pivot connection 28, while second handle 30 is pivotally connected to second jaw 180 at a second handle second pivot connection 38.

Figure 3:
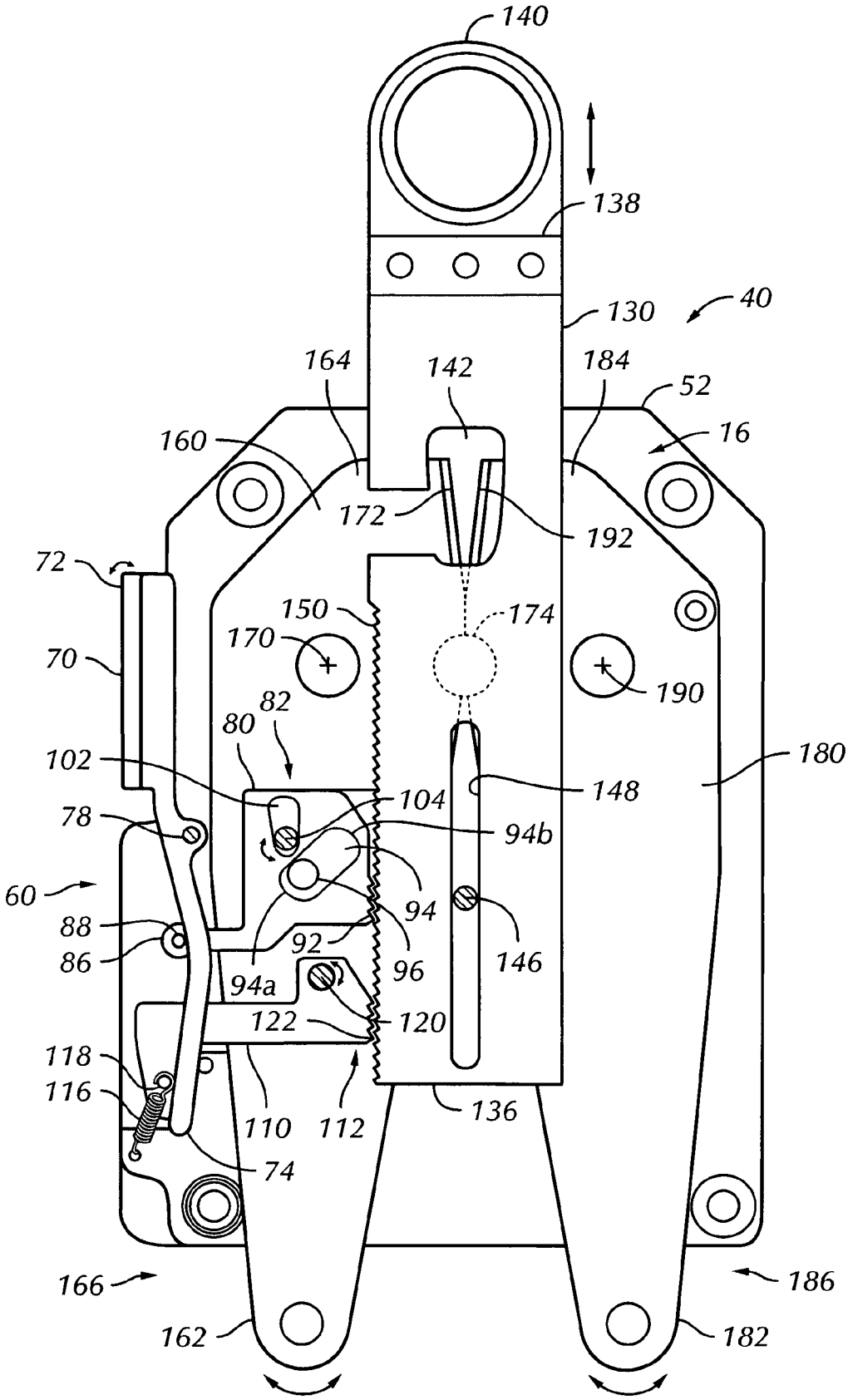
FIG. 3 is an enlarged front elevation view of the cutting head of the cutting tool of FIG. 1, shown with the first and second handles detached and with a cover plate removed.

With particular reference to FIGS. 1-3, the cutting head assembly 40 preferably comprises first and second cover plates 50, 52 between which are captured the first jaw 160, the second jaw 180, the first ratchet member 80, the second ratchet member 110, and the slide member 130. Fasteners, such as first and second nut and bolt assemblies 54, 56, as well as additional corner fasteners 58, extend through the first and second cover plates 50, 52 to secure the plates 50, 52 together. The first and second bolt assemblies 54, 56 also serve as pins providing first and second pivot points 170, 190, respectively, for first and second jaws 160, 180.

With reference to FIG. 3, the first ratchet member 80 is preferably a plate structure pivotally connected to at least one of the cover plates 50, 52. The first ratchet member 80 includes a first guide slot 94 sized and shaped to receive a first guide pin 96. The first guide slot 94 has a first end **94*a* and a second end 94*b*. The first guide pin 96 is fixedly connected to, and consequently moves with, the first jaw 160. The first ratchet member 80 further includes a second guide slot 102 sized and shaped to receive a second guide pin 104. The second guide pin 104 is fixedly connected to cover plate 52 as shown or cover plate 50, if desired. As discussed below, movement of the first jaw 160 and first guide pin 96 drives movement of the first ratchet member 80 relative to the first jaw 160. The first ratchet member 80 further includes an extension arm 86 operatively engaged with release lever 70 by a pin 88. The first ratchet member 80 further includes a plurality of ratchet teeth 92 sized, shaped, and positioned to operatively engage mating ratchet teeth 150 provided on the slide member 130**, as discussed further below.

The second ratchet member 110 is also preferably a plate structure pivotally mounted to at least one of the cover members 50, 52 by a pin 120 on which the second ratchet member 110 pivots. The second ratchet member 110 is provided with a plurality of ratchet teeth 122, sized, shaped, and positioned for operative engagement with the slide member ratchet teeth 150, as discussed below. The second ratchet member 110 is operatively engaged with a release lever 70 by a pin 118, and is biased into a first position 112 by biasing spring 116 which attaches to pin 118.

Figure 4:
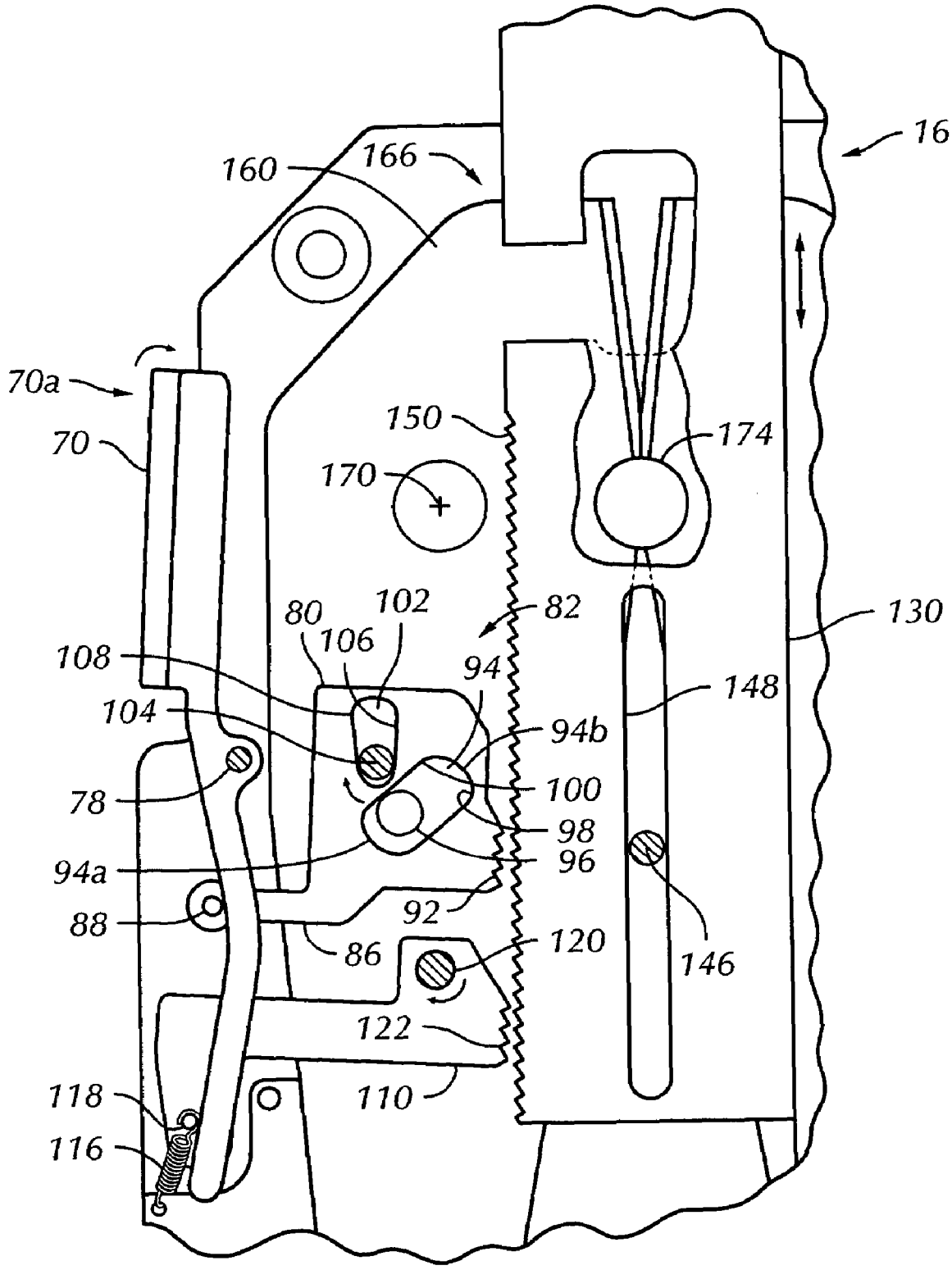
FIG. 4 is an enlarged front elevation view of a portion of the cutting head of the cutting tool of FIG. 3, shown with a release lever moved to a release position to rotate first and second ratchet members out of engagement with a slide member.
Figure 5:
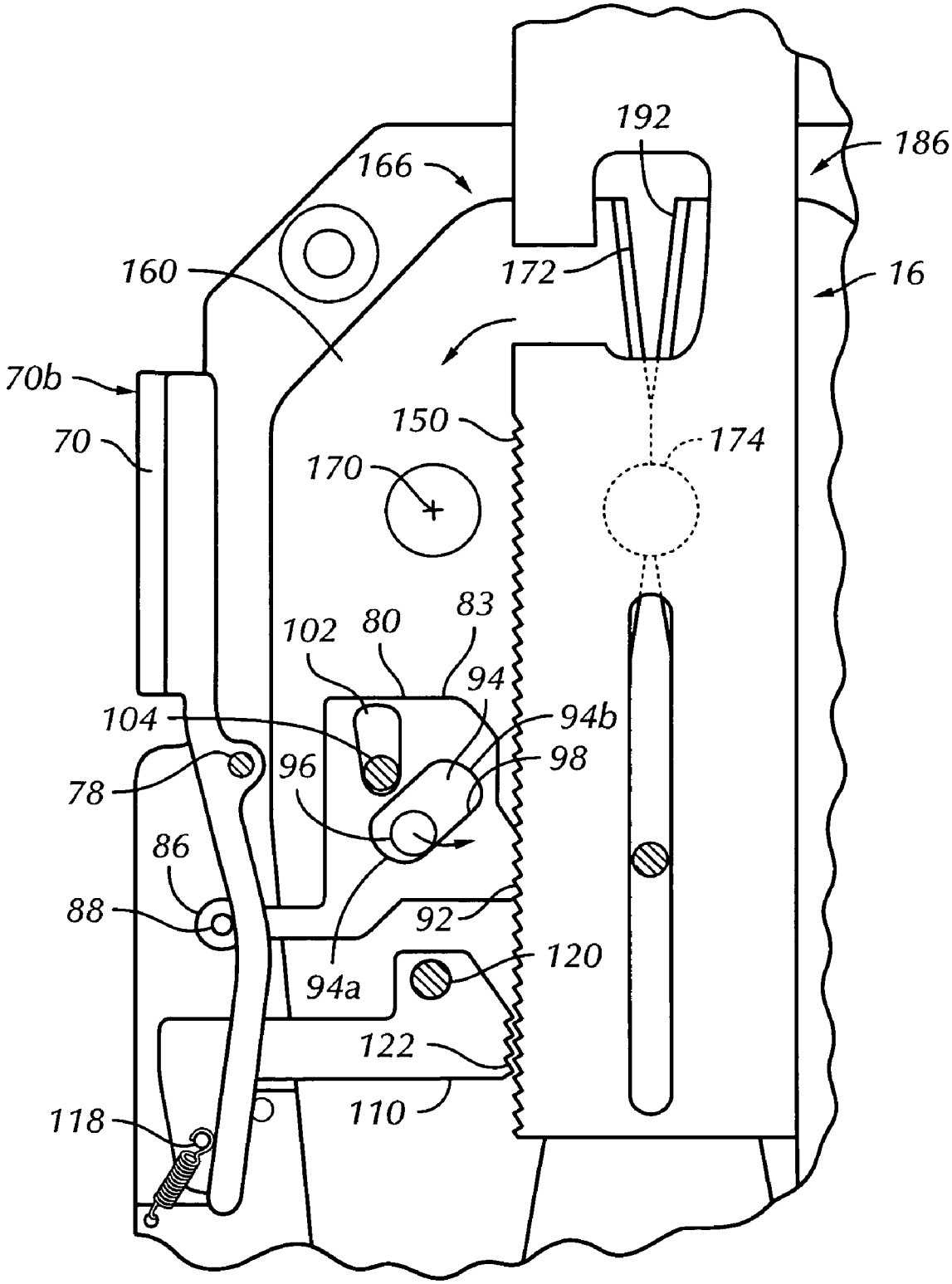
FIG. 5 is an enlarged front elevation view of a portion of the cutting head of the cutting tool of FIG. 3, shown with the first ratchet member operatively engaged with the slide member to move the slide member toward the fully retracted position.
Figure 6:
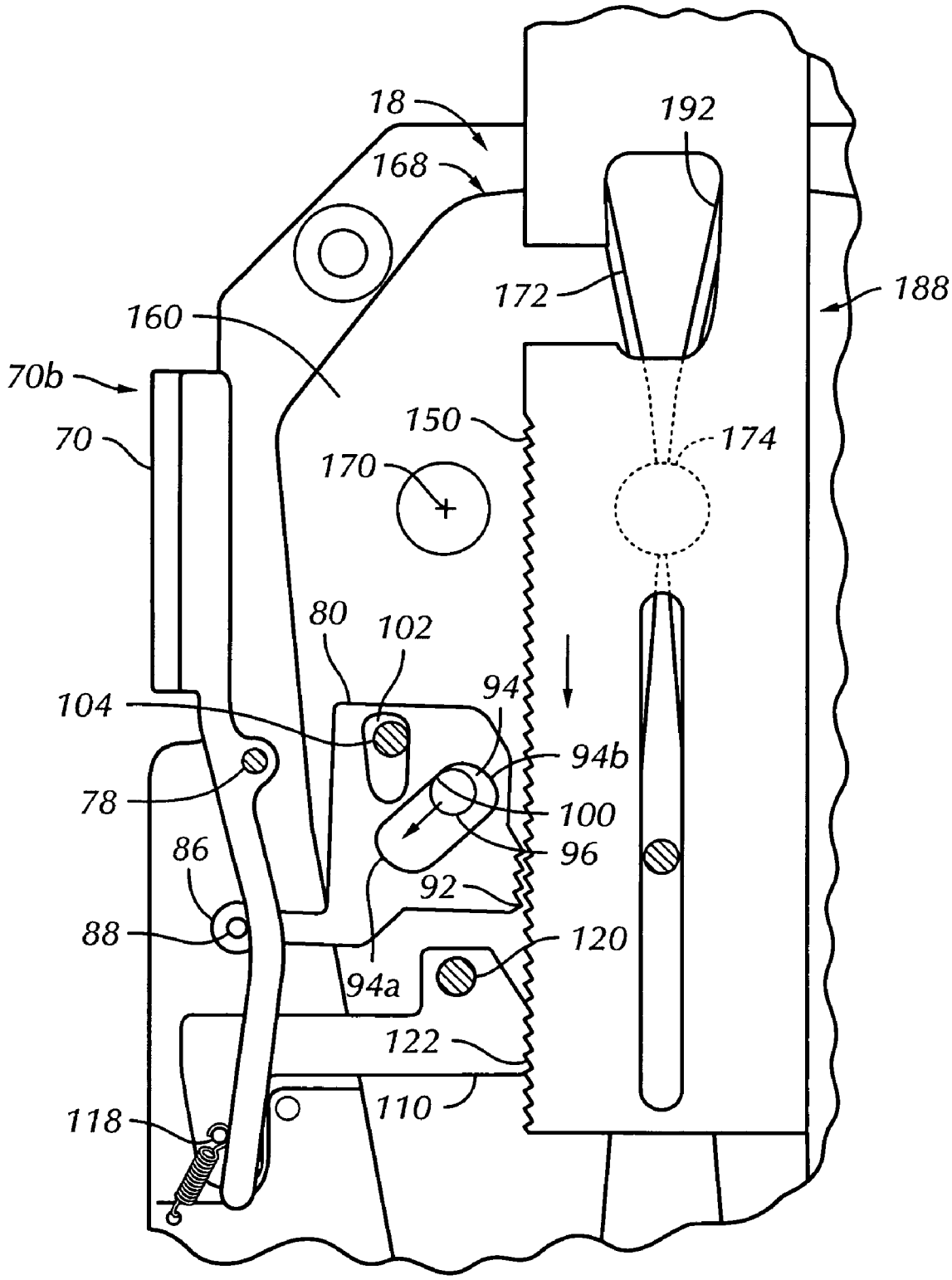
FIG. 6 is an enlarged front elevation view of a portion of the cutting head of the cutting tool of FIG. 3, shown with a second ratchet member operatively engaged with the slide member to restrain the slide member from movement toward the fully extended position.

The release lever 70 is pivotally connected to at least one of the cover plates 50, 52 for pivotal movement between a release position **70*a* (see FIG. 4) and a latched position 70*b* (see FIGS. 5-6). The release lever 70 has a first end 72 and a second end 74. The release lever 70 pivots about pivot pin 78. The release lever 70 operatively engages first and second ratchet members pins 88, 118 to rotate the first and second ratchet members, as discussed below. The release lever 70 is biased into the latched position 70*b* by biasing spring 116**.

With reference now to FIGS. 1-3, the slide member 130 is preferably an elongated plate having a first end 136 and a second end 138. The slide member 130 is movable between a fully retracted position 132 (see FIG. 1) most proximal the first and second jaws 160, 180 and a fully extended position 134 (see FIG. 2) most distal the first and second jaws 160, 180. A pull ring 140 is operatively connected to the slide member 130 proximate the second end 138 preferably by being formed in the second end of the slide member 130, although the pull ring 140 could be formed separately, and mechanically joined to the slide member 130. The pull ring 140 facilitates gripping of the slide member 130 when the slide member 130 is being manually extended or retracted, as discussed further below.

In FIG. 2, the slide member 130 includes a workpiece slot 142, having a side entry passage 144. With the slide member 130 in the fully extended position 134, the workpiece slot 142 and side entry passage 144 are extended clear of the cover plates 50, 52, allowing a work piece (not illustrated), such as a metal cable, to be inserted into the work piece slot 142 via the side entry passage 144.

To facilitate movement of the slide member 130 relative to a remainder of the cutting head assembly 40, a slide pin 146 is fixedly connected to at least one of the cover plates 50, 52 and extends through a slide pin slot 148 (see FIGS. 3 and 4) formed in the slide member 130. The slide pin 146 helps maintain proper alignment of the slide member 130 as it moves between the fully extended position 134 and the fully retracted position 132.

A plurality of ratchet teeth 150 are provided along a side edge of the slide member 130, and are sized, shaped, and positioned to operably engage the first ratchet member teeth 92 and the second ratchet member teeth 122, as discussed below.

With particular reference again to FIG. 3, the first and second cutting jaws 160, 180 are illustrated to be similar to cutting jaws disclosed in currently pending, allowed U.S. patent application Ser. No. 10/256,617, which is incorporated herein by reference in its entirety. It is to be understood, however, that the work piece feed mechanism assembly 60 of the present invention is not limited to use with any particular type of cutting jaws. For example, conventional scissors-type cutting jaws, or conventional pliers-type blade and anvil cutting jaws could be used with the work piece feed mechanism 60.

The first jaw 160 has a first end 162, a second end 164, and an edge extending between the first and second ends. At least a portion of the first jaw edge proximate the second end 164 is sharpened to form a cutting edge portion 172. Similarly, the second jaw 180 has a first end 182, a second end 184 and an edge extending between the first and second ends. With the cutting jaws 160, 180 assembled in the cutting head assembly 40, at least a portion of the second jaw edge faces the cutting edge portion 172, forming a facing edge portion 192. The facing edge portion 192 can be sharpened, or alternatively the facing edge portion 192 may be flat, forming an anvil surface relative to the cutting edge portion 172.

The first and second jaws 160, 180 are movable about pivot points 170, 190, respectively, between first positions 166, 186, respectively (see FIGS. 3-5) and second positions 168, 188, respectively (see FIG. 6). Jaw first positions 166, 186 correspond to the jaws closed position 16 wherein the cutting edge portion 172 and the facing edge portion 192 are in cutting opposition. The jaws closed position 16 corresponds to the handle closed position 12. The jaw second positions 168, 188 correspond to the jaws open position 18 wherein the cutting edge portion 172 and the facing edge portion 192 are spaced apart. The jaws open position 18 corresponds to handle open position 14. Preferably, a fulcrum pin 174 is provided between first and second jaws 160, 180. The fulcrum pin 174 is conventional. It will be understood that the fulcrum pin 174 moves as the first and second jaws 160, 180 pivot about pivot points 170, 190. That is, the fulcrum pin 174 is not connected to either of the cover plates 50, 52.

The first and second ratchet members 80, 110 are movable among various positions. With reference now to FIG. 4, with the release lever 70 moved to the release position 70*a*, the release lever 70 rotates the first and second ratchet members 80, 110 clockwise, pulling the first ratchet member teeth 92 and the second ratchet member teeth 122 out of engagement with slide member teeth 150. Released from engagement with the first and second ratchet members 80, 110, the slide member 130 may be manually extended or retracted, preferably by gripping the pull ring 140.

With reference now to FIG. 5, with the release lever 70 moved to latching position 70*b*, as the handles are moved from the closed position 12 to the open position 14, the first jaw 160 moves relative to the first ratchet member 80. More specifically, first guide pin 96 moves with the first jaw 160 to engage a lower edge 98 of the first guide slot 94. As the first jaw 160 and first guide pin 96 continue to move under the action of the handles 20, 30, the first guide pin 96 moves from a position proximate the first end 94*a* of the first guide slot to a position proximate the second end 94*b*. In moving from the first end 94*a* to the second end 94*b*, while simultaneously engaged with the lower edge 98, the first ratchet member 80 is forced into engagement with the slide member 130, and both the first ratchet member 80 and the slide member 130 move relative to the first and second jaws 160, 180 in a direction toward the fully retracted position 132. Thus, any work piece positioned in the work piece slot 142 is pulled toward cutting edge portion 172 and facing edge portion 192 as the handles 20, 30 move from the closed position 12 to the open position 14 (and the jaws 160, 180 move from the closed position 16 to the open position 18).

During movement of the jaws 160, 180 from the closed position 16 to the open position 18, the second ratchet member 110, unlike the first ratchet member 80, remains fixed to at least one of the cover plates 50, 52, and thus the slide member 130 moves relative to the second ratchet member 110. As the slide member 130 moves relative to second ratchet member 110, slide member teeth 150 do not engage, but rather slide or cam over second ratchet member teeth 122.

With reference now to FIG. 6, with the release lever 70 moved to latching position 70*b*, as the handles are returned from the open position 14 to the closed position 12 and the jaws 160, 180 move from the open position 18 to the closed position 16, the first jaw 160 again moves relative to the first ratchet member 80. First guide pin 96 moves with the first jaw 160 to engage an upper edge 100 of the first guide slot 94. As the first jaw 160 and first guide pin 96 continue to move under the action of the handles 20, 30, the first guide pin 96 moves from a position proximate the slot second end 94*b* to a position proximate the slot first end 94*a*. In moving from the slot second end 94*b* to the slot first end 94*a*, while simultaneously engaged with the upper edge 100, the first ratchet member 80 is forced out of engagement with the slide member 130, allowing the slide member 130 and the first ratchet member 80 to move relative to one another as the handles 20, 30 are closed. Simultaneously, the second ratchet member teeth 122 operatively engage the slide member teeth 150, and prevent movement of the slide member 130 (and any work piece supported within the work piece slot 142) relative to the jaws 160, 180. Thus, during a cutting stroke (wherein the jaws 160, 180 move from the open position 18 to the closed position 16), any work piece positioned in the work piece slot 142 is held in position relative to cutting edge portion 172 and facing edge portion 192 by the second ratchet member 110 and slide plate 130.

In operation, the release lever 70 is moved to the release position 70*b*, rotating the first and second ratchet members 80, 110 out of engagement with the slide member 130. The slide member 130 may then be moved into or near the fully extended position 134, allowing access to the work piece slot entry passage 144. The user may insert a work piece (not shown) into the work piece slot 142, via work piece entry passage 144.

With the work piece (not shown) operably supported by the slide member 130 in the work piece slot 142, actuating forces are the applied to the first ends 162 and 182 of the first and second jaws 160, 180, respectively. The forces are preferably applied by the handles 20, 30, but from this disclosure, it would be obvious to substitute other conventional power sources (such as electrical, pneumatic, or hydraulic means) for the manually-operated handles 20, 30. The forces are applied to move the first and second jaws 160, 180 from their closed position 16 (corresponding to jaw first positions 166 and 186) to their open position 18 (corresponding to jaw second positions 168 and 188), thus opening a gap between the first jaw cutting edge 172 and the second jaw facing edge 192. As the jaws 160, 180 move from the closed position 16 to the open position 18, as described above, the first ratchet member 80 is biased into operative engagement with the slide member 130 to advance the slide member 130 relative to the jaws 160, 180 in a direction toward the fully retracted position 132. Thus, as the jaws 160, 180 open, a work piece (not shown) supported by the slide member 130 is pulled into jaws.

The user then proceeds to manually move the handles 20, 30 (or apply other force generating means to the jaws 160, 180) to move the jaws 160, 180 from the open position 18 to the closed position 16. As discussed above, during movement of the jaws from the open position 18 to the closed position 16, the second ratchet member 110 is biased into operative engagement with the slide member 130, restraining the slide member 130 from movement toward the fully extended position 134. That is, the second ratchet member 110 holds the slide member 130 stationary relative to the jaws 160, 180, allowing the first jaw cutting edge 172 and the second jaw facing edge 192 to score or cut into the work piece (not shown) as the jaws close.

The user repeats the cycle of opening and closing the jaws 160, 180, incrementally advancing the slide member 130 and the work piece (not shown) into the jaws with each cycle. The cutting head assembly 40 is dimensioned such that as the slide member 130 reaches the fully retracted position 132, the work piece will be fully advanced into the jaws, and fully severed by the abutting portions of the cutting edges.

The preferred material of construction for the first and second jaws 160, 180, respectively, is hardened tool steel. The preferred materials of construction for the remainder of the cutting head assembly components is cold-rolled steel. Other materials having sufficient strength and rigidity could be substituted. The handles 20, 30 are preferably fabricated from cold-rolled steel tubing, but could be formed from other materials such as carbon-fiber reinforced composite materials.

A cutting tool with a work piece feed mechanism is thus disclosed which is especially well-adapted for incremental cutting of thick, difficult to cut components such as Aluminum Conductor Steel Reinforced (ASCR) cable.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention as defined by the appended claims.

What is claimed is:

1. A cutting tool with a work piece feed mechanism, comprising:

a first jaw having first and second ends and an edge extending between the first and second ends, at least a portion of the first jaw edge proximal the first end being sharpened to form a cutting edge portion;

a second jaw having first and second ends and an edge extending between the first and second ends, at least a portion of the second jaw edge facing the cutting edge portion of the first jaw edge;

the first and second jaws being connected together for pivotal movement between a closed position with the cutting edge portion and the facing edge portion in cutting opposition and an open position with the cutting edge portion and the facing edge portion spaced apart; and a work piece feed mechanism operably coupled with at least one of the first and second jaws and including a slide member adapted to engage a work piece and slide with the work piece relative to the first and second jaws between a fully extended position most distal to the first and second jaws and a fully retracted position most proximal to the first and second jaws;

wherein, with the slide member extended from the fully retracted position, movement of the first and second jaws from the closed position to the open position causes a remainder of the work piece feed mechanism to advance the slide member and any work piece supported by the slide member toward the fully retracted position; and wherein movement of the first and second jaws from the open position to the closed position causes the remainder of the work piece feed mechanism to operably restrain the slide member from movement toward the fully extended position.

2. The cutting tool of claim 1, wherein in the closed position, a part of the cutting edge portion of the first jaw and a part of the facing portion of the second jaw fully abut one another in a pliers action in an abutment section so as to prevent any further movement of the first and second jaws together while an angled gap is formed between a remaining free end of the cutting edge portion of the first edge of the first jaw and a remaining free end of the facing portion of the first edge of the second jaw, the remaining free ends of the first edges of the first and second jaws extending away from one another and from the abutment section.

3. The cutting tool of claim 1, the work piece feed mechanism further including:

a first ratchet member operably coupled with one of the first and second jaws; and a second ratchet member operably coupled with one of the first and second jaws;

wherein:

with the slide member extended from the fully retracted position, movement of the first and second jaws from the closed position to the open position causes the first ratchet member to operably engage the slide member and advance the slide member and any work piece supported by the slide member relative to the first and second jaws in a direction toward the fully retracted position; and movement of the first and second jaws from the open position to the closed position causes the second ratchet member to operably engage the slide member to restrain the slide member from movement relative to the first and second jaws in a direction toward the fully extended position.

4. The cutting tool of claim 3, wherein the at least first end portions of the first and second jaws have sharpened opposing, facing edges.

5. The cutting tool of claim 3, wherein an edge of the first end portion of the first jaw is sharpened and an opposing, facing edge of the first end portion of the second jaw is flat, such that the second jaw edge functions as an anvil to the first jaw sharpened edge.

6. The cutting tool of claim 3, wherein the slide member, first ratchet member, and second ratchet member each includes one or more ratchet teeth.

7. The cutting tool of claim 3, further comprising at least one cover plate, wherein the first and second jaws are each pivotally connected to the cover plate.

8. The cutting tool of claim 7, wherein the first ratchet member and the second ratchet member are plates each pivotally connected to the cover plate.

9. The cutting tool of claim 7 wherein the work piece feed mechanism further comprises a release lever connected to the cover plate for pivotal movement into and from a release position wherein the release lever forces the first and second ratchet members out of engagement with the slide member, allowing the slide member to be manually moved relative to the first and second jaws.

10. The cutting tool of claim 7 further comprising a first guide pin fixedly connected to the first jaw and the first ratchet member having a first guide slot sized and shaped to receive the first guide pin for sliding movement therein.

11. The cutting tool of claim 10 further comprising a second guide pin fixedly connected to the cover plate, and the first ratchet member having a second guide slot sized and shaped to receive the second guide pin for movement therein.

12. The cutting tool of claim 10, wherein the slide member, the first ratchet member and the second ratchet member each includes one or more ratchet teeth and, wherein, with the slide member extended from the fully retracted position, movement of the first jaw from the closed position to the open position results in movement of the first guide pin to force the first ratchet member ratchet teeth into operative engagement with the slide member ratchet teeth, and further forces movement of the first ratchet member and the slide member relative to the first jaw, resulting in movement of a work piece engaged by the slide member relative to the first jaw in a direction toward the fully retracted position.

13. The cutting tool of claim 10, wherein the slide member, the first ratchet member and the second ratchet member each includes one or more ratchet teeth and, wherein with the slide member extended from the fully retracted position, movement of the first jaw from the open position to the closed position results in movement of the first guide pin to force the first ratchet member teeth out of operative engagement with the slide member teeth, and the second ratchet member teeth are biased into operative engagement with the slide member teeth to restrain movement of the slide member relative to the first jaw, resulting in restraint of movement of a work piece engaged by the slide member relative to the first jaw and relative to the fully retracted position.

14. The cutting tool of claim 3, wherein the first ratchet member is pivotally connected to the first jaw.

15. The cutting tool of claim 3, wherein the second ratchet member is pivotally connected to one of the first jaw and the second jaw.

16. The cutting tool of claim 3, the first jaw having first and second ends and an edge extending between the first and second ends, at least a portion of the first jaw edge being sharpened to form a cutting edge portion and the second jaw having first and second ends and an edge extending between the first and second ends, at least a portion of the second jaw edge facing the first jaw edge, wherein in the closed position, a part of the cutting edge portion of the first jaw and a part of the facing portion of the second jaw fully abut one another in a pliers action in an abutment section so as to prevent any further movement of the first and second jaws together and an angled gap is formed between a remaining free end of the cutting edge portion of the first edge of the first jaw and a remaining free end of the facing portion of the first edge of the second jaw, the remaining free ends of the first edges of the first and second jaws extending away from one another and from the abutment section.

17. The cutting tool of claim 3 further comprising means to pivot the first and second jaws relative to one another between the open position and the closed position.

18. The cutting tool of claim 17, the means to pivot the first and second jaws including first and second handles operably coupled to the first and second jaws, respectively, wherein movement of the first and second handles between a handle closed position and a handle open position forces movement of the first and second jaws between the closed position and the open position, respectively.

* * * * *